US011079199B1

(12) United States Patent
Helfrich

(10) Patent No.: US 11,079,199 B1
(45) Date of Patent: Aug. 3, 2021

(54) PELLET MAGAZINE

(71) Applicant: John M. Helfrich, McPherson, KS (US)

(72) Inventor: John M. Helfrich, McPherson, KS (US)

( * ) Notice: Subject to any disclaimer, the term of this patent is extended or adjusted under 35 U.S.C. 154(b) by 0 days.

(21) Appl. No.: 17/166,163

(22) Filed: Feb. 3, 2021

(51) Int. Cl.
*F41B 11/55* (2013.01)
*F41A 9/65* (2006.01)

(52) U.S. Cl.
CPC ..... *F41B 11/55* (2013.01); *F41A 9/65* (2013.01)

(58) Field of Classification Search
CPC ..... F41B 11/55; F41A 9/65; F41A 9/67
USPC ..... 124/45, 51.1, 52, 53; 42/49.01
See application file for complete search history.

(56) References Cited

U.S. PATENT DOCUMENTS 1,886,704 A * 11/1932 Loomis ..... F41A 9/72 124/52
2,037,313 A * 4/1936 Duncanson ..... F41B 7/006 124/2
3,515,111 A * 6/1970 Auge ..... A63F 9/0252 124/16
3,572,310 A * 3/1971 Chiba ..... F41A 9/65 124/76
3,818,887 A * 6/1974 Akiyama ..... F41B 11/55 124/67
4,850,328 A * 7/1989 Sindel ..... F41A 9/41 124/67
4,993,400 A * 2/1991 Fitzwater ..... F41B 11/54 124/48
5,666,937 A * 9/1997 Mendoza-Orozco ... F41B 11/54 124/48
6,530,368 B1 * 3/2003 Maeda ..... F41B 11/55 124/48
6,736,125 B2 * 5/2004 Petrosyan ..... F41B 11/55 124/51.1
6,832,605 B2 * 12/2004 Farrell ..... F41A 11/06 124/76
6,860,258 B2 * 3/2005 Farrell ..... F41A 11/06 124/49
7,950,382 B2 * 5/2011 Maeda ..... F41B 11/55 124/73
8,578,919 B2 * 11/2013 Macy ..... B65D 25/32 124/45
9,022,015 B2 * 5/2015 Tseng ..... F41A 9/70 124/51.1

(Continued)

*Primary Examiner* — Alexander R Niconovich
(74) *Attorney, Agent, or Firm* — Dale J. Ream

(57) ABSTRACT

A pellet magazine for attachment to a pellet gun includes an elongate casing having opposing top and bottom walls extending between first and second ends and opposing left and right sidewalls that, together, fine a magazine channel. The bottom wall defines an outlet port adjacent the first end. The magazine channel includes pellet and spring channel portions. A plurality of pellets may be inserted into the pellet channel portion. A compression spring is included in pellet spring channel portion to urge the plurality of pellets toward the outlet port. A pellet pocket member is rotatably coupled to the casing and positioned in the magazine channel in communication with the portion channel for moving a respective pellet from the loaded configuration to the unloaded configuration when actuated. The pellet pocket member is coupled to an actuation switch to sequentially actuate the pellet pocket to urge a pellet through the outlet port.

18 Claims, 9 Drawing Sheets

(56) References Cited

U.S. PATENT DOCUMENTS

| | | | | |
|---|---|---|---|---|
| 9,038,304 | B1 * | 5/2015 | Hu | F41A 9/71<br>42/49.01 |
| 9,103,614 | B2 * | 8/2015 | Froehle | F41A 9/67 |
| 9,366,499 | B2 * | 6/2016 | Maeda | F41B 11/60 |
| 9,587,903 | B2 * | 3/2017 | Sullivan | F41A 19/12 |
| 10,145,635 | B2 * | 12/2018 | Hefer | F41A 9/83 |
| 10,302,383 | B2 * | 5/2019 | Maga | F41A 9/70 |
| 2003/0056777 | A1 * | 3/2003 | Liang | F41A 9/65<br>124/52 |
| 2007/0235014 | A1 * | 10/2007 | Tiberius | F41B 11/723<br>124/52 |
| 2009/0301456 | A1 * | 12/2009 | Barwick, Jr. | F41B 11/54<br>124/45 |
| 2012/0160225 | A1 * | 6/2012 | Cho | F41B 11/55<br>124/52 |
| 2014/0096755 | A1 * | 4/2014 | Larmer | F41B 11/55<br>124/52 |
| 2019/0234704 | A1 * | 8/2019 | Culiat | F41B 11/681 |

* cited by examiner

PELLET MAGAZINE

BACKGROUND OF THE INVENTION

This invention relates generally to pellet feed systems and, more particularly, to a pellet magazine having a finger-operable actuation switch mechanically coupled to a pellet pocket configured to dispense a prospective pellet from a block of stored pellets out of the magazine and into a pellet gun.

A pellet gun refers to a gun that propels a non-spherical projectile from an airgun, the projectile typically being smaller and bullets and shot used in firearms. Traditionally, pellet guns have been used to protect one's home from rodents and other similar undesirable animals. Pellet guns are purposely designed to be of relatively low power for reasons of safety and to be financially accessible to home-owners. Pellet guns may also be used for target practice and for children to use before graduating to more significant firearms.

Traditional pellet guns may have relatively small magazines for dispensing pellets to be propelled. It would be desirable to have a pellet magazine capable of holding and dispensing a plurality of pellets one at a time as a user operates a finger-operable actuation switch that is mechanically coupled to a pellet pocket configured to capture a next pellet stored in a spring-operated magazine channel and dispense the captured pellet through an outlet port and into a pellet gun.

SUMMARY OF THE INVENTION

A pellet magazine for removable attachment to a pellet gun according to the present invention includes an elongate rectangular shaped casing having opposing top and bottom walls extending between first and second ends along with opposing left and right sidewalls that, together, a magazine channel extending interiorly between the first and second ends. The bottom wall defines an outlet port adjacent the first end. The magazine channel includes a pellet channel portion and a pellet spring channel portion. A plurality of pellets may be inserted into the pellet channel portion. A compression spring is included in pellet spring channel portion and configured to normally urge the plurality of pellets toward the outlet port. A pellet pocket member is rotatably coupled to the casing and positioned in the magazine channel in communication with the portion channel for moving a respective pellet from the loaded configuration to the unloaded configuration when actuated. The pellet pocket member may be coupled to an actuation switch configured to sequentially actuate the pellet pocket to urge a respective pellet through the outlet port.

Therefore, a general object of this invention is to provide a pellet magazine operable for use in supplying a pellet gun with a steady supply of pellets.

Another object of this invention is to provide a pellet magazine, as aforesaid, having an actuation switch that requires a user to dispense a next pellet before taking a shot.

Still another object of this invention is to provide a pellet magazine, as aforesaid, having a pellet pocket assembly for capturing a next pellet and then rotating to dispense the captured pellet when actuated by operation of the actuation switch.

Yet another object of this invention is to provide a pellet magazine, as aforesaid, that is economical to manufacture and purchase.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
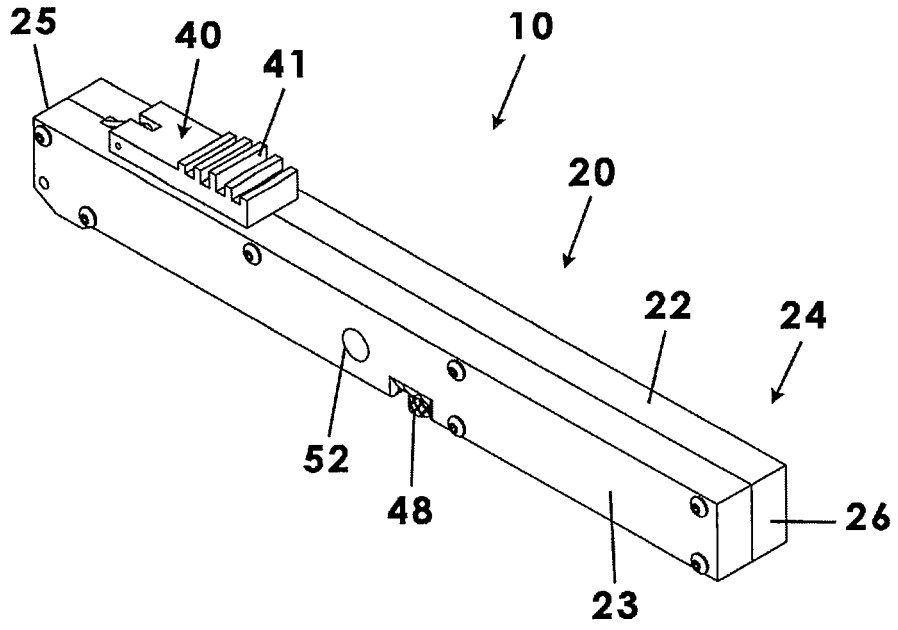
FIG. 1*a* is a perspective view of a pellet magazine according to a preferred embodiment of the invention.
Figure 1B:
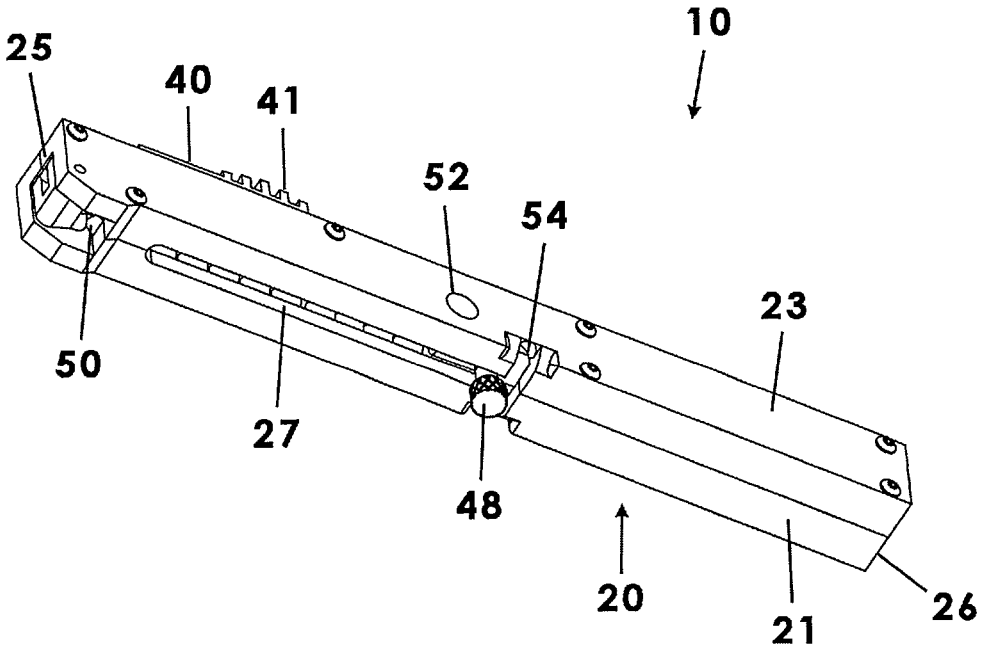
FIG. 1*b* is another perspective view, taken from a lower angle, of the pellet magazine as in FIG. 1*a;*
Figure 2:
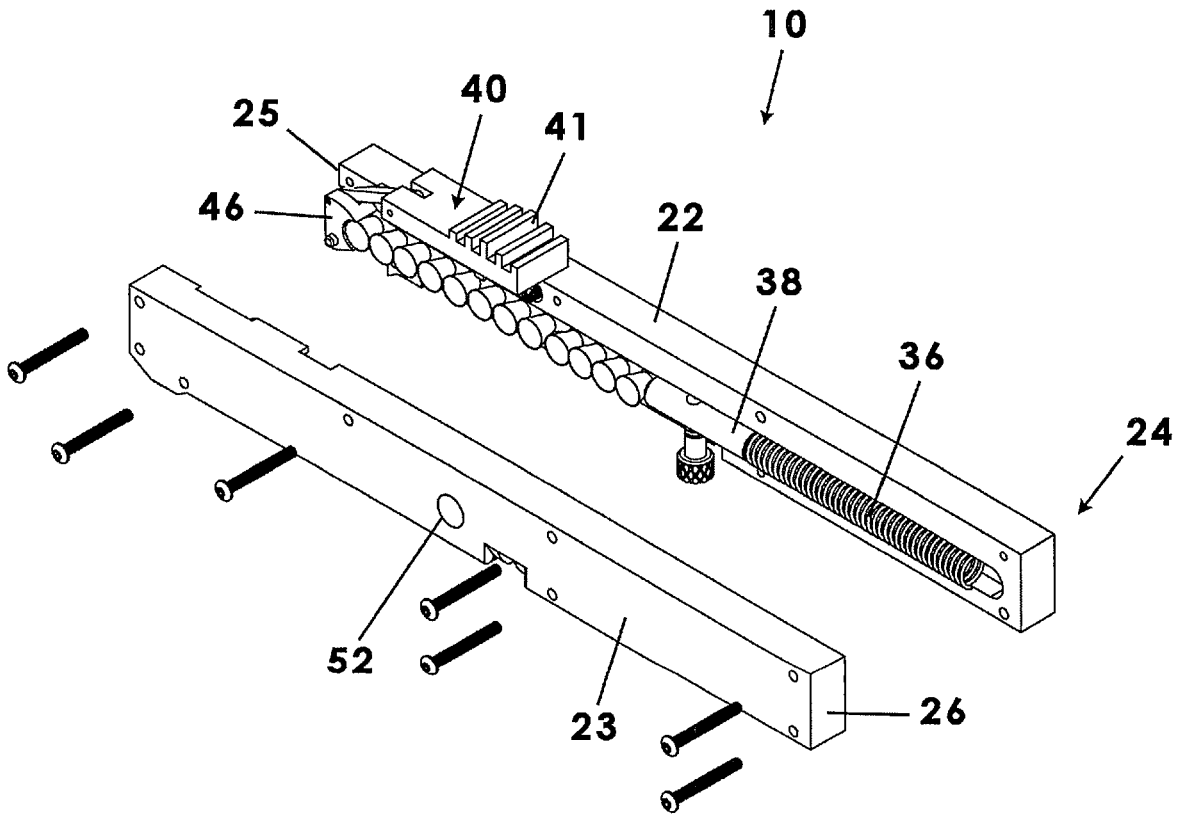
FIG. 2 is an exploded view of the pellet magazine as in FIG. 1*a;*

A pellet magazine according to a preferred embodiment of the present invention will now be described with reference to FIG. 1*a* to 9*b* of the accompanying drawings. The pellet magazine 10 includes a casing 20 having a plurality of walls that define a magazine channel 30 that will refer to a pellet channel and a spring channel. The pellet magazine 10 also includes an actuation switch 40 mechanically coupled to a pellet pocket 46 that is rotatably coupled to the casing 20 and configured to capture and dispense a next pellet 15 in the pellet channel through an outlet port 50 when actuated by the actuation switch 40.

The casing 20 has the appearance of an elongate three-dimensional or 3D orthotope (i.e., rectangular) housing having a bottom wall 21 and a top wall 22 opposite and parallel to the bottom wall 21 extending in parallel between a first end 25 and a second end 26. The first end 25 and second end 26 may be closed such as by walls. The casing 20 also includes a left sidewall 23 and a right sidewall 24 opposite the left sidewall 23, the left and right sidewalls 23, 24 extending peripherally between the bottom wall 21 and top wall 22. Accordingly, the walls described above, together, form a closed exterior except as described below and define a magazine channel 30 interiorly, the magazine channel 30 extending substantially between the first end 25 and second end 26. The magazine channel 30, for clarity, will be described as having a pellet channel portion 32 extending away from the first end 25 and having a pellet spring portion 36 extending away from the second end 26. The terminal and of the pellet spring portion 36 may be referred to as an inner end, again for clarity of description and drawings.

In an embodiment, a plurality of pellets 14 is received and situated in the pellet channel portion 32 of the magazine channel 30, such as by insertion through a loading port 52 defined by the left sidewall 23. It is understood, of course, that the loading port 52 may be defined by other walls of the casing 20 and has a dimension that is complementary to that of a pellet to be inserted therethrough. The plurality of pellets 14 may be referred to as a pellet block and each individual pellet may be referred to as a respective pellet.

In an embodiment, the bottom wall 21 of the casing 20 may define an outlet port 50 adjacent the first end 25 through which a respective pellet from an inserted pellet block may be dispensed from the pellet channel portion 32 into a pellet gun 12. As will be described in more detail below, the plurality of pellets 14 may be moved sequentially from a loaded configuration entirely situated in the pellet channel portion 32 to and unloaded configuration outside the casing 20 (i.e., into a pellet gun 12 or BB gun or the like) by sequentially being dispensed through the outlet port 50. Clearly, the outlet port 50 is in communication with the pellet channel portion 32.

Dispensing a respective pellet 15 involves mechanical operation of a pellet advancement assembly that includes a pellet pocket 46, an actuation switch 40, a linkage connecting the pellet pocket 46 and actuation switch 40, an actuation spring 42, and a pellet advancement spring 34 that is positioned in the spring channel portion 33. More particularly, the actuation switch 40 is a button or flange having a dimension of sufficient area to receive at least one finger of a user. In fact, the actuation switch 40 may include a grip portion 41 that extends upwardly from an upper surface of the actuation switch 40 and which enhances a user's ability to manipulate the actuation switch 40. Preferably, the actuation switch 40 has an ergonomic configuration that is easy to urge rearwardly as will be described below. The actuation switch 40 is slidably coupled to the top wall 22 of the casing 20. The actuation switch 40 is slidably movable between a capture configuration adjacent the first end 25 of the casing 20 and a deployment configuration that is a rearwardly displaced from the first end 25. An actuation spring 42 is positioned inside the casing 20 (such as in a spring chamber) and operatively coupled to the actuation switch 40. Preferably, the actuation spring 42 is a compression spring that is compressed when the actuation switch 40 is pulled rearwardly from the capture configuration to the deployment configuration by a user's manual manipulation and then urges or releases the actuation switch 40 to return to the capture configuration. In other words, the actuation switch 40 is normally biased toward the capture position (also called a released or at rest configuration). As will be described later, it is this movement of the actuation switch 40 that sets in motion a dispensing of a respective pellet 15.

Further, the pellet advancement assembly includes a pellet pocket 46. The pellet pocket 46 is a flange or component that is rotatably coupled to a respective sidewall of the casing 20 and mechanically coupled to the actuation switch 40 via a linkage so as to rotate in correlation with the slidable movements of the actuation switch 40 described above. The linkage may include an actuation lever 44 having a linear configuration, the actuation lever 44 having a proximal end rotatably coupled to a forward end of the actuation switch 40 and a distal end rotatably coupled to a rear edge of the pellet pocket 46. It is understood that the attachment points are suitable so as to rotate the pellet pocket 46 in a clockwise direction when the actuation switch 40 is moved rearwardly toward the deployment configuration and vice versa.

Now in more detail, the pellet pocket 46 is positioned adjacent the first end 25 of the casing 20, adjacent the outlet port 50, and adjacent a next pellet from the pellet block to be dispensed. The pellet pocket 46 may include a front edge having a U-shaped or otherwise recessed configuration in which the next pellet to be dispensed is captured or nested. Thus, when the actuation switch 40 is in the capture configuration, the next pellet to be dispensed is, in fact, being captured by the pellet pocket. Then, when the actuation switch 40 is pulled rearwardly, the pellet pocket 46 is rotated by connection of the actuation lever 44 as described above and such that respective pellet 15 is dispensed and falls through the outlet port 50.

Figure 7:
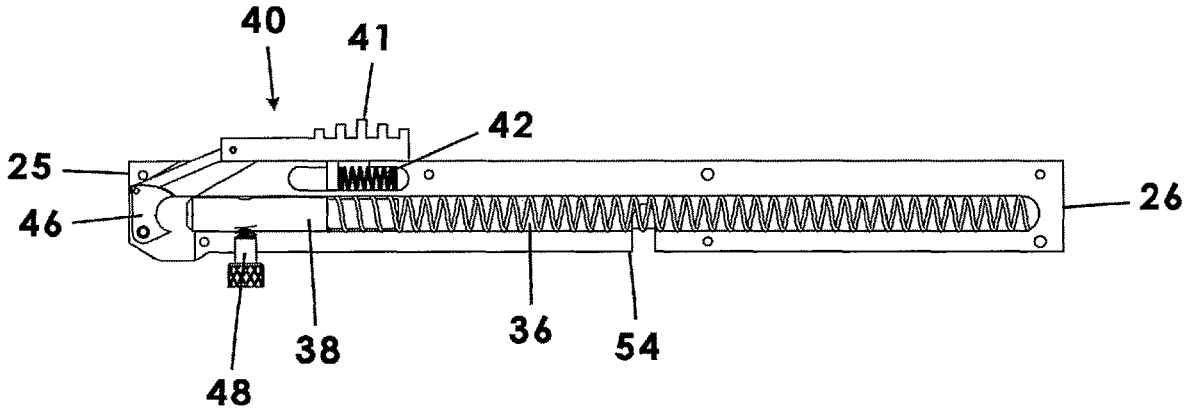
FIG. 7 is a a side view of the pellet magazine as in FIG. 6*a*, illustrating the pellet magazine completely empty of pellets and the compression spring completely expanded within the magazine channel.

The plurality of pellets 14 of the pellet block are urged in the direction of the pellet pocket 46 and outlet port 50 by operation of a pellet advancement spring 34 situated in the spring channel portion 33 of the magazine channel 30. The pellet advancement spring 34 is an assembly that includes the spring portion 36 and a guide member 38, the guide member being intermediate the spring portion 36 and the pellet block. As shown, the guide member 38 is actually in bearing contact with a last pellet in the pellet block. Preferably, the spring portion 36 is a compression spring such that the spring portion is compressed as the number of pellets inserted into the pellet channel portion 32 is increased and, then, is naturally expanded as respective pellets are dispensed as described above. As shown in FIG. 7, the pellet advancement spring 34 may expand to fill the entire magazine channel 30 when all of the plurality of pellets 14 have been dispensed and therefore, removed from the magazine channel 30.

Figure 8A:
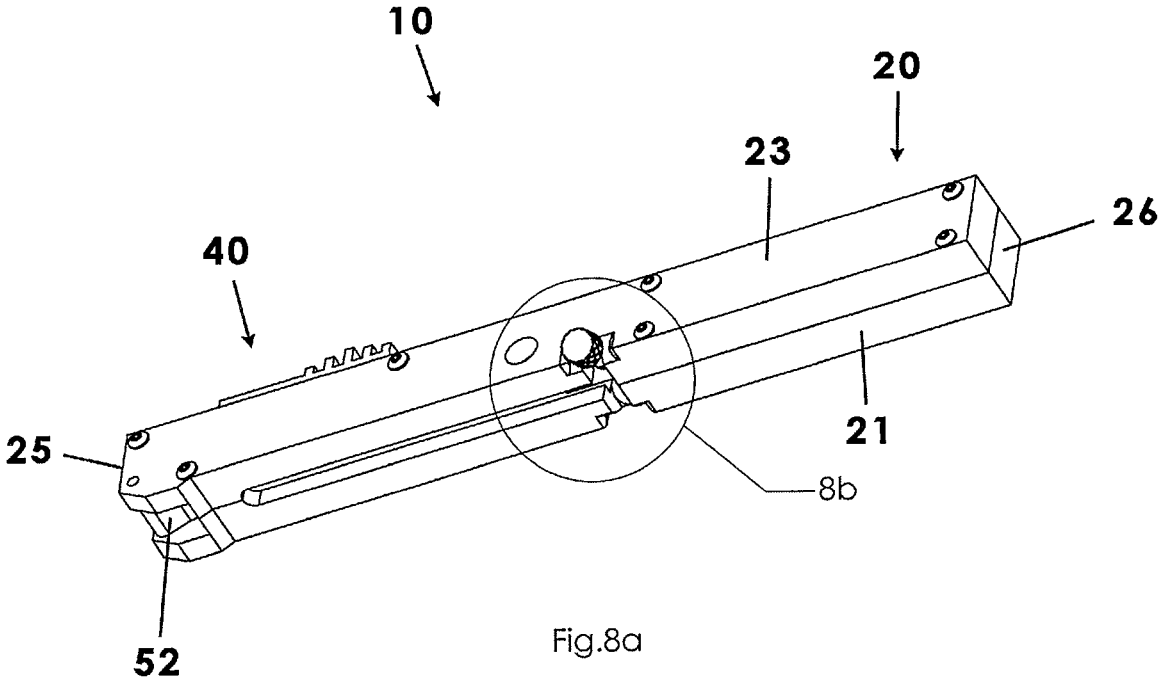
FIG. 8*a* is a perspective view of the pellet magazine shown in FIG. 1*b;*
Figure 8B:
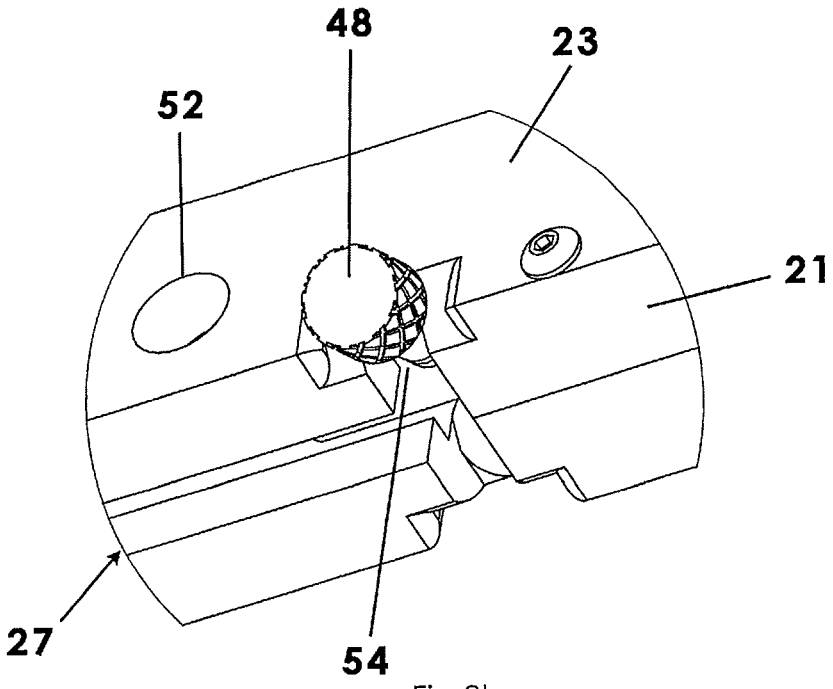
FIG. 8*b* is an isolated view on an enlarged scale taken from FIG. 8*a;*
Figure 9A:
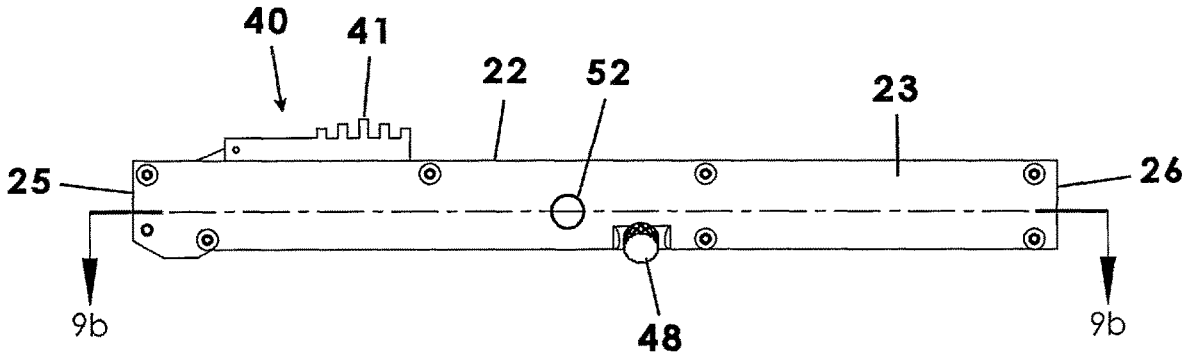
FIG. 9*a* is a side view of the pellet magazine shown in FIG. 1*a*.
Figure 9B:
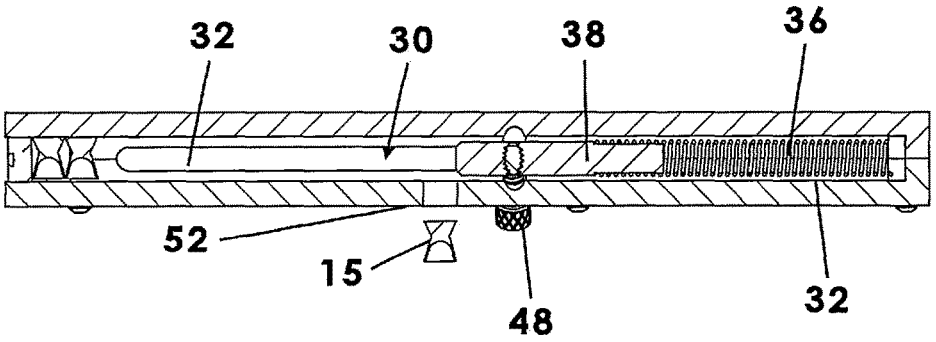
FIG. 9*b* is a sectional view taken along line 9*b*-9*b* of FIG. 9*a.*

In another aspect, the pellet magazine 10 may include a magazine block lock 48 threadably coupled to the guide member 38 of the pellet advancement spring 34, the block lock 48 being rotatably movable between a released configuration displaced from the guide member 38 and a locked configuration bearing against the guide member 38. The block lock 48 may include a knob that may be grasped and rotated by a user. It is understood that longitudinal movement of the pellet advancement spring 34 is stopped when block lock 48 is at the locked configuration. Use of the block lock 48 is shown in FIGS. 8*a* and 8*b*. Respective walls of the casing 20 may define a pellet loading notch 54. The block lock 48 may be nested in the pellet loading notch 54 (which may cause the guide member to rotate) and rotatably set to a locked configuration when additional pellets need to be inserted through the pellet loading port 52.

In a related aspect, the bottom wall 21 of the casing 20 may define a magazine sliding slot 27 having a dimension that is complementary to the block lock 48 such that the block lock 48 may be received therein and moves slidably therein as respective pellets are dispensed and the pellet advancement spring 34 expands in the direction of the first end 25.

Figure 3A:
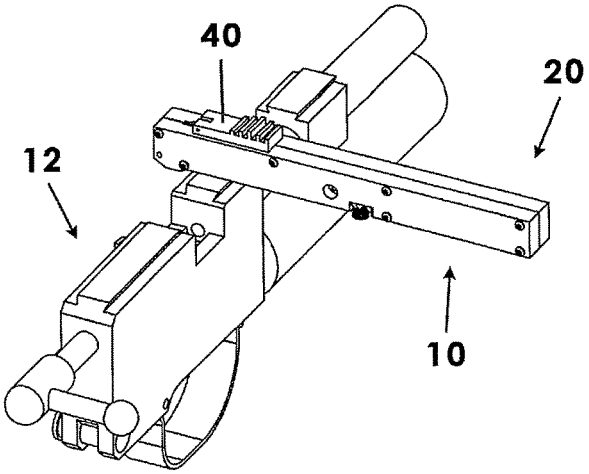
FIG. 3*a* is a perspective view of the pellet magazine elevated above the breach of a pellet gun according to the present invention.
Figure 3C:
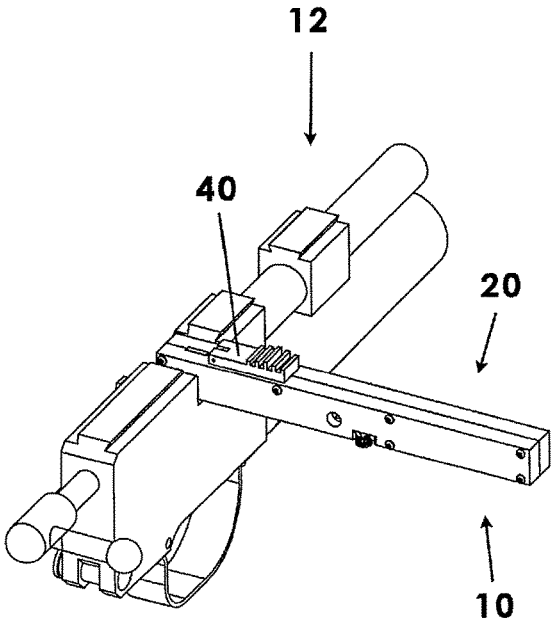
FIG. 3*c* is a perspective view of the pellet magazine positioned within the breach of the pellet gun, illustrated with the actuation switch released back into the dispensed configuration.
Figure 3B:
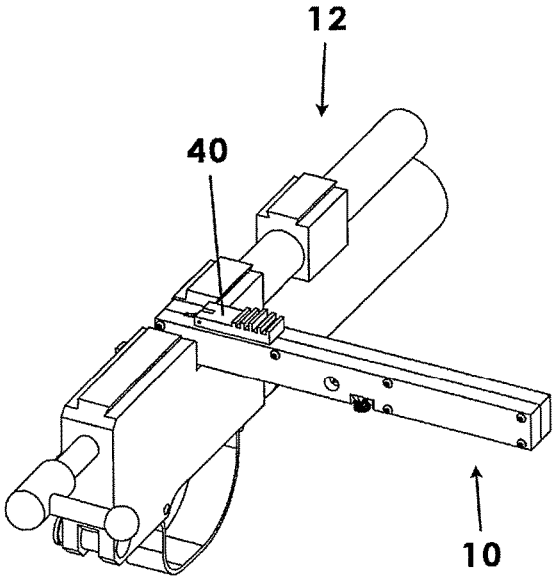
FIG. 3*b* is a perspective view of the pellet magazine positioned within the breach of a pellet gun, illustrated with the actuation switch pulled back in and actuated configuration.
Figure 4A:
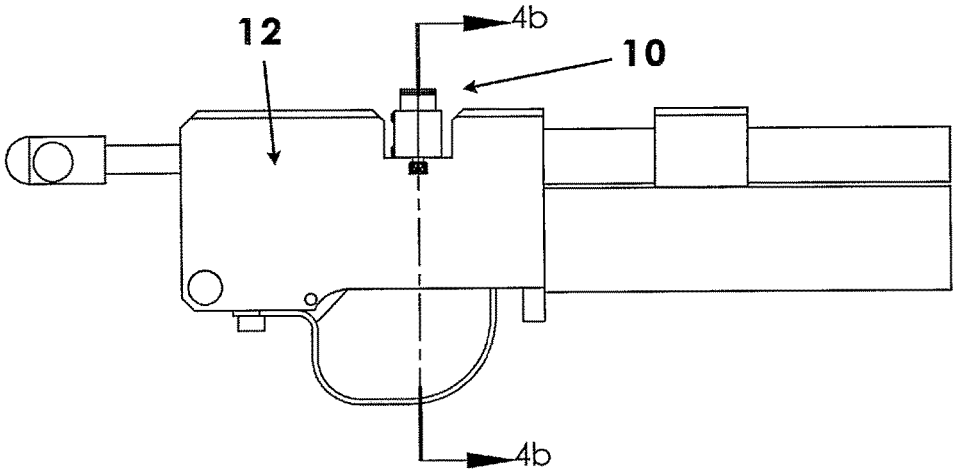
FIG. 4*a* is a side view of the pellet magazine and pellet gun illustrated in FIG. 3*b;*
Figure 4B:
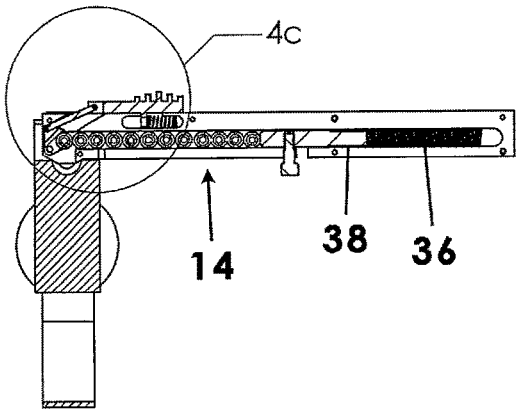
FIG. 4*b* is a sectional view taken along line 4*b*-4*b* of FIG. 4*a;*
Figure 4C:
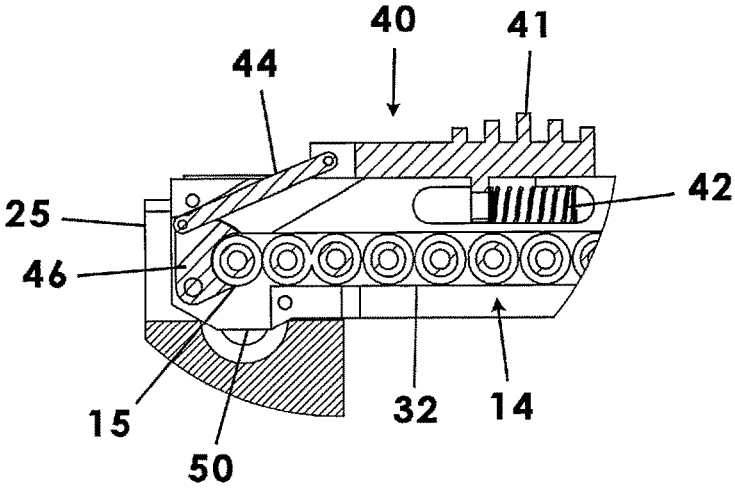
FIG. 4*c* is an isolated view on an enlarged scale taken from FIG. 4*b;*
Figure 5A:
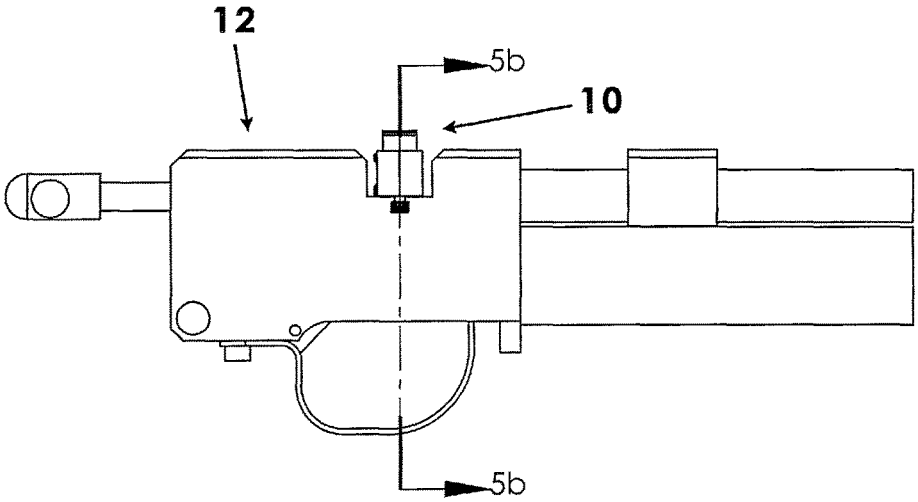
FIG. 5*a* is a side view of the pellet magazine and pellet gun illustrated in FIG. 3*c;*
Figure 5B:
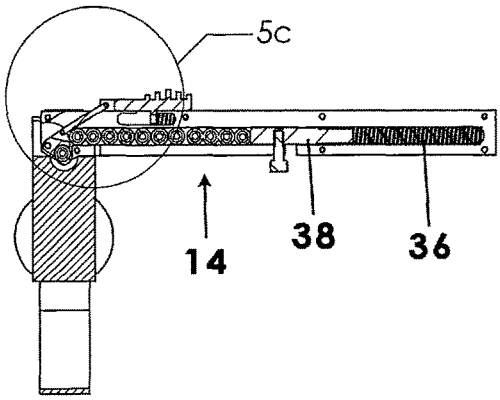
FIG. 5*b* is a sectional view taken along line 5*b*-5*b* of FIG. 5*a;*
Figure 5C:
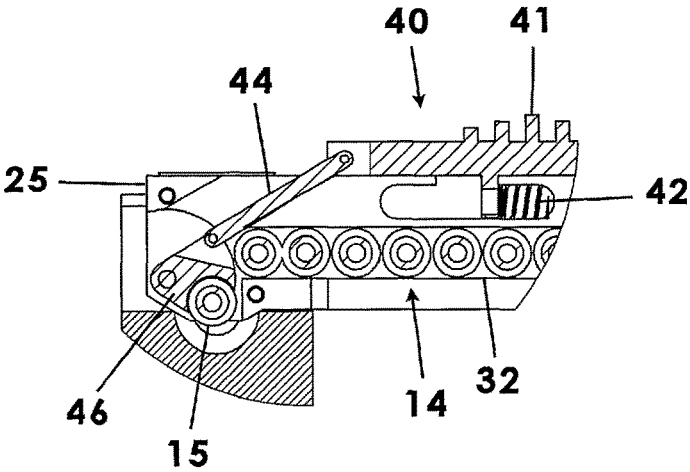
FIG. 5*c* is an isolated view on an enlarged scale taken from FIG. 5*b;*
Figure 6A:
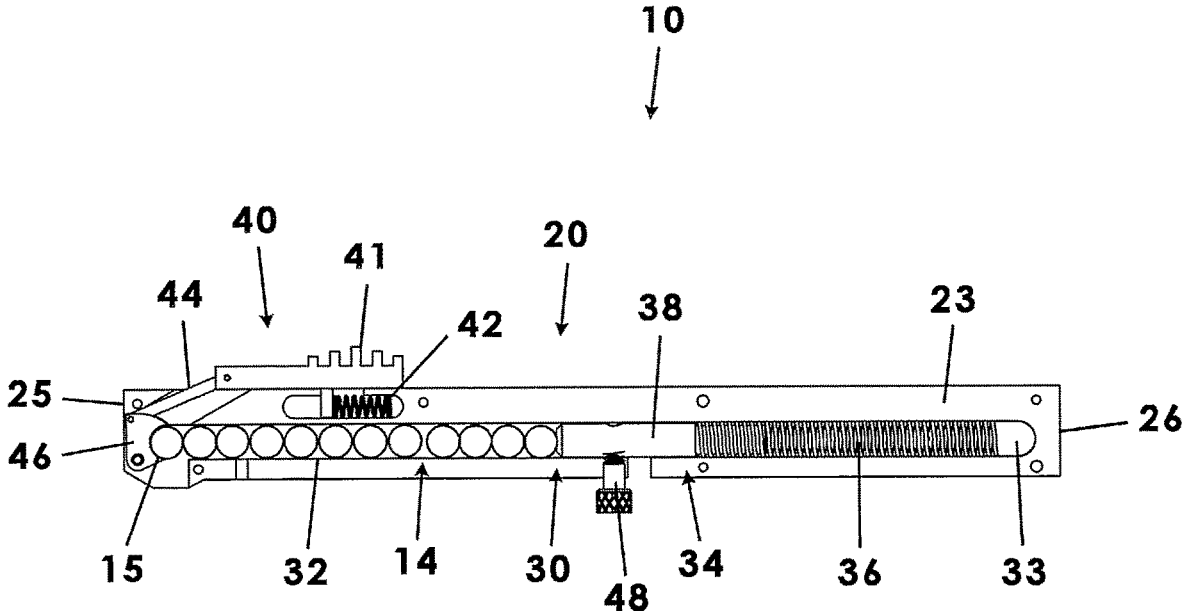
FIG. 6*a* is a side view of the pellet magazine with a left sidewall removed for clarity, illustrated with the actuation switch in a released and at rest configuration.
Figure 6B:
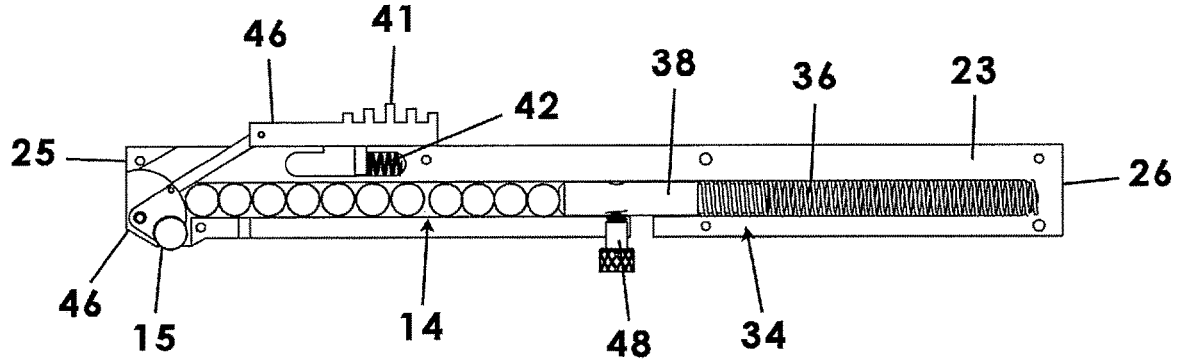
FIG. 6*b* is a side view of the pellet magazine as in FIG. 6*a*, illustrated with the actuation switch in a biased or actuated configuration causing the pellet pocket to rotate and dispense a captured pellet.

In use, the pellet magazine 10 provides a superior and efficient means for dispensing pellets into a pellet gun. A plurality of pellets 14 may be inserted into the pellet channel portion 32 through the loading port 52. Then, respective pellets may be dispensed sequentially by manual operation of the actuation switch 40 and pellet pocket 46. Movement pulling the actuation switch 40 rearwardly is shown in FIG. 3*c* and FIG. 5*c* so as to rotate the pellet pocket 46 and thus dispense a captured pellet 15. Then, action of the actuation spring 42 returning the pellet pocket 46 to the capture configuration so as to capture a next pellet 15 is shown in FIG. 3*b* and FIG. 4*c*.

It is understood that while certain forms of this invention have been illustrated and described, it is not limited thereto except insofar as such limitations are included in the following claims and allowable functional equivalents thereof.

The invention claimed is:

1. A pellet magazine for holding a plurality of pellets, comprising:

a casing having a bottom wall and a top wall opposite said bottom wall, said bottom and top walls being parallel to one another and extending between a first end and a second end that is opposite said first end, said casing including a left sidewall and a right sidewall opposite said left sidewall, said left and right sidewalls being parallel to one another and extending between said bottom and top walls, respectively;

wherein said bottom, top, left side, and right side walls of said casing, together, define a magazine channel extending between an outlet port adjacent said first end and an inner end adjacent said second end;

wherein said magazine channel includes a pellet channel portion approximate said first end and a pellet spring portion proximate said second end;

wherein the pellet channel portion is configured to hold the plurality of pellets when the plurality of pellets is loaded therein and the plurality of pellets is movable from a loaded configuration situated in said pellet channel portion through said outlet port and an unloaded configuration situated outside said pellet channel;

a pellet pocket member rotatably coupled to said casing and positioned in said magazine channel in communication with said pellet channel for moving a respective pellet from said loaded configuration to said unloaded configuration when actuated;

an actuation switch slidably coupled to said top wall proximate said first end of said casing, said actuation switch being slidably movable between a deployment configuration rearwardly displaced from said first end and a capture configuration adjacent said first end;

an actuation spring operably coupled to said actuation switch for naturally biasing said actuation switch toward said capture configuration;

a linkage connecting said actuation switch to said pellet pocket, said linkage having a linear configuration that rotates said pellet pocket to push a captured pellet through said outlet port when said actuation switch is moved toward said deployment configuration and that rotates said pellet pocket in an opposite direction when said actuation switch is released to said capture configuration.

2. The pellet magazine as in claim 1, wherein said linkage includes an actuation lever having a proximal end rotatably coupled to a forward end of said actuation switch and a distal end rotatably coupled to a rear edge of said pellet pocket.

3. The pellet magazine as in claim 1, wherein said actuation spring is a compression spring that is compressed when said actuation switch is urged rearwardly toward said deployment configuration and that is expanded when said actuation switch is released.

4. The pellet magazine as in claim 3, wherein said actuation switch includes a grip portion extending upwardly from an upper surface and that is ergonomic.

5. The pellet magazine as in claim 1, further comprising a pellet advancement assembly situated in said pellet channel, said pellet advancement assembly including a spring member proximate said inner end of said magazine channel and a guide member coupled to said spring member displaced from said inner end and situated intermediate said spring member and said plurality of pellets.

6. The pellet magazine as in claim 5, wherein said pellet advancement spring is a compression spring that is compressed when respective pellets from said plurality of pellets are inserted into said pellet channel and that is naturally expanded in said magazine channel as respective pellets are deployed from said pellet channel.

7. The pellet magazine as in claim 6, further comprising a magazine block lock situated in proximity to said guide member of said pellet advancement spring assembly, said magazine block lock being rotatable between a released configuration displaced from said guide member and a locked configuration bearing against said guide member so as to stop longitudinal movement of said guide member in said magazine channel.

8. The pellet magazine as in claim 7, wherein said bottom wall of said casing defines a magazine sliding slot in communication with said magazine block lock such that said magazine block lock moves slidably along said magazine sliding slot as said respective pellets are moved sequentially out of said pellet channel portion and out through said outlet port.

9. The pellet magazine as in claim 1, wherein said left sidewall defines a loading port in communication with said magazine channel, said loading port having a dimension sufficient for receiving said plurality of pellets into said pellet channel.

10. A pellet magazine for attachment to a pellet shooting device, said pellet magazine comprising:

a casing includes an elongate three-dimensional orthotope having a bottom wall and a top wall opposite said bottom wall, said bottom and top walls being parallel to one another and extending between a first end and a second end that is opposite said first end, said casing including a left sidewall and a right sidewall opposite said left sidewall, said left and right sidewalls being parallel to one another and extending between said bottom and top walls, respectively;

wherein the walls of said casing, together, define a magazine channel extending interiorly between said first end and said second end;

wherein said magazine channel includes a pellet channel portion proximate said first end and a pellet spring portion proximate said second end;

a plurality of pellets movable from a loaded configuration situated in said pellet channel portion and an unloaded configuration situated outside said pellet channel;

wherein said casing defines an outlet port adjacent said first end that is in communication with said magazine channel, said outlet port having a dimension for allowing sequential passage of said plurality of pellets to said unloaded configuration;

a pellet pocket member rotatably coupled to said casing and positioned in said magazine channel proximate said first end and in communication with said pellet channel for moving a respective pellet from said loaded configuration through said outlet port to said unloaded configuration when actuated;

an actuation switch slidably coupled to said top wall proximate said first end of said casing, said actuation switch being slidably movable between a deployment configuration rearwardly displaced from said first end and a capture configuration adjacent said first end;

an actuation spring coupled to said actuation switch for normally biasing said actuation switch toward said capture configuration;

a linkage connecting said actuation switch to said pellet pocket, said linkage having a linear configuration that rotates said pellet pocket to push a captured pellet through said outlet port when said actuation switch is moved toward said deployment configuration and that rotates said pellet pocket in an opposite direction when said actuation switch is released to said capture configuration;

a pellet advancement assembly situated in said pellet channel, said pellet; and advancement assembly including a spring member proximate said inner end of said magazine channel and a guide number coupled to said spring member displaced from said inner end and situated intermediate said spring member and said plurality of pellets.

11. The pellet magazine as in claim 10, wherein said linkage includes an actuation lever having a proximal end rotatably coupled to a forward end of said actuation switch and a distal end rotatably coupled to a rear edge of said pellet pocket.

12. The pellet magazine as in claim 11, wherein said actuation spring is a compression spring that is compressed when said actuation switch is urged rearwardly toward said deployment configuration and that is expanded when said actuation switch is released.

13. The pellet magazine as in claim 12, wherein said actuation switch includes a grip portion extending upwardly from an upper surface and that is ergonomic.

14. The pellet magazine as in claim 10, wherein said pellet advancement spring is a compression spring that is compressed when respective pellets from said plurality of pellets are inserted into said pellet channel and that is normally expanded in said magazine channel as respective pellets are deployed from said pellet channel.

15. The pellet magazine as in claim 10, wherein said left sidewall defines a loading port in communication with said magazine channel, said loading port having a dimension sufficient for receiving said plurality of pellets into said pellet channel.

16. The pellet magazine as in claim 15, further comprising a magazine block lock situated in proximity to said guide member, said magazine block lock being rotated between a released configuration displaced from said guide member and a locked configuration bearing against said guide member so as to stop longitudinal movement of said guide member in said magazine channel.

17. The pellet magazine as in claim 16, wherein said bottom wall of said casing defines a magazine sliding slot in communication with said magazine block lock such that said magazine block lock moves slidably along said magazine sliding slot as said respective pellets are moved sequentially out of said pellet channel portion and out through said outlet port.

18. The pellet magazine as in claim 10, wherein said pellet pocket includes a front edge defining a recessed portion for capturing a respective pellet in a nested relationship.

* * * * *